US009162134B2

(12) United States Patent
Schwartz

(10) Patent No.: US 9,162,134 B2
(45) Date of Patent: Oct. 20, 2015

(54) LACROSSE TRAINING AND COMPETITIVE GAME INSTALLATION WITH VARIABLE TRAJECTORY CONTROL

(71) Applicant: Ralph Schwartz, Massapequa Park, NY (US)

(72) Inventor: Ralph Schwartz, Massapequa Park, NY (US)

( * ) Notice: Subject to any disclaimer, the term of this patent is extended or adjusted under 35 U.S.C. 154(b) by 91 days.

(21) Appl. No.: 13/869,506

(22) Filed: Apr. 24, 2013

(65) Prior Publication Data

US 2013/0296079 A1 Nov. 7, 2013

Related U.S. Application Data

(60) Provisional application No. 61/687,406, filed on Apr. 24, 2012.

(51) Int. Cl.

| | |
|---|---|
| ***A63B 69/00*** | (2006.01) |
| ***A63B 69/40*** | (2006.01) |
| ***A63B 47/02*** | (2006.01) |
| ***A63B 63/06*** | (2006.01) |
| ***A63B 71/02*** | (2006.01) |
| ***A63B 71/06*** | (2006.01) |
| *A63B 63/00* | (2006.01) |
| *A63B 24/00* | (2006.01) |

(52) U.S. Cl.

CPC ..... *A63B 69/40* (2013.01); *A63B 47/025* (2013.01); *A63B 63/06* (2013.01); *A63B 69/406* (2013.01); *A63B 71/022* (2013.01); *A63B 71/06* (2013.01); *A63B 71/0605* (2013.01); *A63B 63/007* (2013.01); *A63B 69/002* (2013.01); *A63B 69/0097* (2013.01); *A63B 2024/0037* (2013.01); *A63B 2063/001* (2013.01); *A63B 2071/0694* (2013.01); *A63B 2220/40* (2013.01); *A63B 2220/833* (2013.01); *A63B 2243/005* (2013.01)

(58) Field of Classification Search

CPC ..... A63B 69/00; A63B 63/00; A63B 69/40; A63B 69/0026; A63B 69/36; A63B 63/06; A63B 63/004

USPC ..... 473/422, 415, 446, 465, 471, 478

See application file for complete search history.

(56) References Cited

U.S. PATENT DOCUMENTS

| | | | |
|---|---|---|---|
| 3,765,675 A | 10/1973 | DiMarzio | |
| 4,607,842 A | 8/1986 | Daoust | |
| 4,995,607 A | 2/1991 | Whitfield | |

(Continued)

FOREIGN PATENT DOCUMENTS

| | | | |
|---|---|---|---|
| FI | WO9524950 A1 | 9/1995 | |
| WO | WO 9101778 A1 * | 2/1991 | ..... A63B 63/00 |
| WO | WO91/01778 A1 | 4/2011 | |

*Primary Examiner* — Mitra Aryanpour

(74) *Attorney, Agent, or Firm* — Alfred M. Walker

(57) ABSTRACT

A lacrosse training and competitive game installation includes an elongated enclosed space having side walls and a goal area adjacent one end thereof and a player area at an opposite end thereof. The goal area includes a rear wall and one or more forward projecting side baffle regions projecting forward from the rear wall of the goal area. Each of the one or more side baffle regions has one or more throwing apertures through which lacrosse balls are hurled into the enclosed space in sequence. A ball projector assembly is mounted behind each baffle adjacent each of the throwing apertures for hurling the lacrosse balls into the enclosed space simulating passed balls between players. A simulated goal is preferably rotatable in the goal area for throwing and shooting of balls at various angles to a goal. Balls are collected from the goal area and delivered to each ball projector assembly.

29 Claims, 7 Drawing Sheets

(56) References Cited

U.S. PATENT DOCUMENTS

| | | | | |
|---|---|---|---|---|
| 5,004,235 | A * | 4/1991 | Suga | 473/415 |
| 5,396,876 | A | 3/1995 | Liscio et al. | |
| 5,498,000 | A | 3/1996 | Cuneo | |
| 5,509,650 | A | 4/1996 | MacDonald | |
| 5,509,652 | A | 4/1996 | Woronets | |
| 5,707,304 | A | 1/1998 | BelleIsle | |
| 5,776,019 | A | 7/1998 | Kronenberger | |
| 6,059,673 | A * | 5/2000 | Mason | 473/478 |
| 6,174,237 | B1 | 1/2001 | Stephenson | |
| 6,514,160 | B1 * | 2/2003 | Cooper | 473/415 |
| 6,966,853 | B1 | 11/2005 | Wilkerson et al. | |
| 7,104,901 | B1 * | 9/2006 | Mason | 473/446 |
| 7,166,045 | B1 | 1/2007 | Linner et al. | |
| 7,326,132 | B2 | 2/2008 | Olexa | |
| 7,661,679 | B2 | 2/2010 | Mah et al. | |
| 7,854,669 | B2 | 12/2010 | Marty et al. | |
| 8,052,545 | B1 | 11/2011 | Assenheimer, III | |
| 8,152,661 | B2 | 4/2012 | House | |
| 8,182,372 | B2 | 5/2012 | Hayes | |
| 8,182,373 | B2 | 5/2012 | Delorme | |
| 8,287,404 | B2 | 10/2012 | Cucjen et al. | |
| 8,335,345 | B2 | 12/2012 | White et al. | |
| 8,342,968 | B2 | 1/2013 | Fuccillo et al. | |
| 2014/0274481 | A1 * | 9/2014 | Harruna | 473/431 |

* cited by examiner

LACROSSE TRAINING AND COMPETITIVE GAME INSTALLATION WITH VARIABLE TRAJECTORY CONTROL

RELATED APPLICATIONS

This application is based upon provisional patent application Ser. No. 61/687,406 filed on Apr. 24, 2012, and claims priority therefrom pursuant to 28 U.S. Code §119(e). Applicant incorporates the aforementioned provisional application by reference herein.

FIELD OF THE INVENTION

The present invention relates to a lacrosse ball throwing and training system and competitive game installation with variable ball trajectory control.

BACKGROUND OF THE INVENTION

U.S. Pat. No. 7,326,132 of Olexa describes a lacrosse shooting range for practicing lacrosse ball throwing with a ball return mechanism.

U.S. Pat. No. 7,166,045 of Linner an ice hockey game platform (a baseball "batting cage" equivalent), a goal with targets, a computer controlled puck circulator, including a magazine of pucks, a passing unit (i.e. "projector"), which passes (i.e. throws) pucks to a player, a conveyor belt which sorts and conveys already shot pucks into the magazine (i.e. reloads the used pucks) wherein, with a light barrier, a camera and a computer program, the players' shots of pucks toward the quadrangle target are evaluated and assigned a point value in a data network (i.e. score-keeping database of other players) and where the puck magazine is made of an outer tube and an inner tube, with a spiraling helical ramp that is only wide enough so that the pucks moving in progression on the conveyor are aligned in a row behind one another and that the slope and surface of the helical ramp are constructed so that the pucks advance automatically under gravity to the "passing unit (i.e. "projector") to be thrown again in the direction of the player.

PCT WO95-24950 of Gronroos describes a hockey playing platform with a target, a computer, a puck magazine and a passing unit (i.e. projector)

U.S. Pat. No. 5,498,000 of Cuneo describes a Simulated Goaltender with a camera for photographing a player's swing.

U.S. Pat. No. 6,174,237 of Stephenson describes a game tournament scoring database.

U.S. Pat. No. 5,707,304 of BelleIsle describes a hockey training platform with a conveyor belt and two inclined collector surfaces to transport the hockey pucks back to the player.

U.S. Pat. No. 3,765,675 of DiMarzio simulated hockey playing training device with a simulated goalie.

U.S. Pat. No. 7,661,679 B2 of Mah describes an electronic target system for a sports goal This system does not project balls to a player. It simply instruments a goal with multiple hoops or ring elements mounted on the goal frame as target areas. If a projectile ball goes through the hoop, it is detected and feedback is given to player. A player can be guided to a particular target by lights and feedback can be given by lights and/or siren as to hit/miss.

U.S. Pat. No. 7,854,669 B2 Marty describes a trajectory detection and feedback system, which does not project balls to a player. This system detects the trajectory of a thrown "basketball" as shot by a player on a simulated playing area.

The trajectory is detected by video cameras and other sensors and recorded and analyzed by computer with feedback to player, but does not project balls at a desired trajectory to the player.

U.S. Pat. No. 8,052,545 B1 of Assenheimer discloses a sports training device where goal targets are hung from the frame of a goal. If struck by the player's ball, a bell sounds. Assenheimer '545 does not describe a ball projection device which projects a ball toward a player.

U.S. Pat. No. 8,152,661 B2 of House describes a lacrosse training method and apparatus, which uses a lacrosse stick or glove with a laser diode, which transmits a narrow beam of light at a target receiver mounted on a simulated goal. The system is used to train the player in aligning the stick in the proper manner prior to making his or her shot. House '661 does not describe a training method which projects a ball toward a player.

U.S. Pat. No. 8,182,372 B2 of Hayes describes a device for training athletic or sports ball players, which includes a narrow sliver of a goal with vertically dispersed net pouches. If a player hits a ball or puck successfully, it will be captured by one of the nets. Hayes '372 does not disclose a ball projection device which throws balls at a player at desired angles and trajectories.

U.S. Pat. No. 8,287,404 B2 of Cucjen discloses a programmable ball throwing apparatus, which is restricted to a ball projector and the computer system that controls the ball's trajectory path toward the player. Cucjen '404's ball projector does not include vertical height adjustment and the ability for the mechanism to move by motorized wheels. Cucjen '404 uses a pedestal drive motor which controls horizontal aiming. Cucjen '404's launch mechanism is vertical but not horizontal in placement. Cucjen '404 needs vertical launch wheels and separate motors to impart spin by having them rotate at different speeds. Cucjen '404 does not utilize a single launch motor with a belt which rotates both wheels. Cucjen '404 does not describe a tilt mechanism. Because Cucjen '404 does not have a true height adjustment, it cannot duplicate a trajectory where, if one picks a point in three-dimensional (3-D) space, a ball can be launched to the selected point in space at a certain speed from different heights, with resulting different trajectories that cannot be launched from a fixed height. Cucjen '404 also does not describe a motor drive with a motor and a rail for movement of the ball projector.

OBJECTS OF THE INVENTION

It is therefore an object of the present invention to provide a lacrosse ball throwing and training system and competitive game installation where the angle and orientation of the ball thrown toward a practice player can be varied in three dimensions and in arc.

It is also an object of the present invention to provide a lacrosse ball throwing and training system and competitive game installation which closely mimics the variety of balls thrown toward a lacrosse player in a real time game situation.

Other objects which become apparent from the following description of the present invention.

SUMMARY OF THE INVENTION

The present invention is uniquely configured to provide training and competitive simulated games for the game of lacrosse. Although other installations have been devised to offer training for the games of tennis, baseball, hockey and even lacrosse, they have shortcomings in the ability to simulate actual game ball situations. The lacrosse ball has to be thrown at angles, not just from straight ahead like in a pitched baseball in a batting cage. The ability to be thrown from below (as when using a lacrosse stick in an upward swooping motion) as well as from above (stick used over the shoulder in a downward projection), or laterally in a "side arm" projection should be simulated. Balls should be projected from both right and left to develop the ambidexterity demanded by lacrosse.

Other features such as velocity of the projected ball, goal rotation to simulate field relations between player and goal, and the ability to collect player information and session training goals are also important.

With sensor techniques similar to prior art installations such as multiple light curtains, digital cameras, and appropriate software, performance statistics and even a single "session score" can be developed.

The lacrosse training and competitive game installation is an elongated preferably enclosed space with a player area at one end and a rotatable goal at the distal end. Ball projectors are placed on both sides away from the distal end and closer to the player such that trajectories with significant transverse components are possible. Multiple ball projectors at different heights at each side (such as a low and a high projector) can be used, but the expense and the complexity involved in supplying balls to multiple ball projectors is avoided by using a versatile single ball projector subsystem at each side in this invention.

In the basic embodiment (i.e.—stage one), the ball projector is placed at mid height but offers azimuth and elevation control. As such, a control computer can use the desired target location (in 3-D coordinates), desired ball velocity, and left or right projector choice to place the ball at the target by performing a standard ballistics calculation and then setting elevation and azimuth to place a ball at the designated target within the player area. So the ball can be coming from either the right or left side and can be a high parabolic (low velocity) trajectory or a lower flatter high velocity trajectory.

In an alternate optional stage two embodiment, the entire ball projector sub-assembly is placed on a motorized lift table (or alternate elevator mechanism) to offer actual height control. This offers more control over the combinations of ball velocity and desired trajectory.

In a further alternate stage three embodiment, the lift table of stage two with ball projector atop is placed on rails and is provided with motorized wheels to move the ball projector physically closer or farther away from the player to better control the trajectory of the ball in the lateral or forward directions. The control computer must only know the location of the ball projector and the location of the target along with desired ball velocity to calculate actual distance and then perform ballistics computations based on Newtonian physics.

Although other ball projecting methods such as pneumatic can be used, the preferred ball projector of this invention is one using counter-rotating accelerator rollers driven by an adjustable speed motor such as an AC motor with variable frequency supply. The ball projector subsystem uses a hinged platform adjusted by a motor-controlled lead screw for elevation control. The ball projector is also rotated by a separate motor for azimuth control.

The ball return sub-system uses a return pit under the goal and backdrop area with contours guiding returned balls into one of two angled ball canals (one on the right and one on the left) which guide balls by gravity toward respective ball projector sub-assemblies. The ball pit also has a slowly rotating equalizing motivator which moves accumulating balls on one side of the return pit to the opposite side in case balls on one side tend to back up by being returned there more often. Each ball projector subsystem has an attached ball elevator which scoops balls one at a time from the adjacent ball canal and lifts them above a tube which conveys a single ball to the accelerator rollers upon command.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
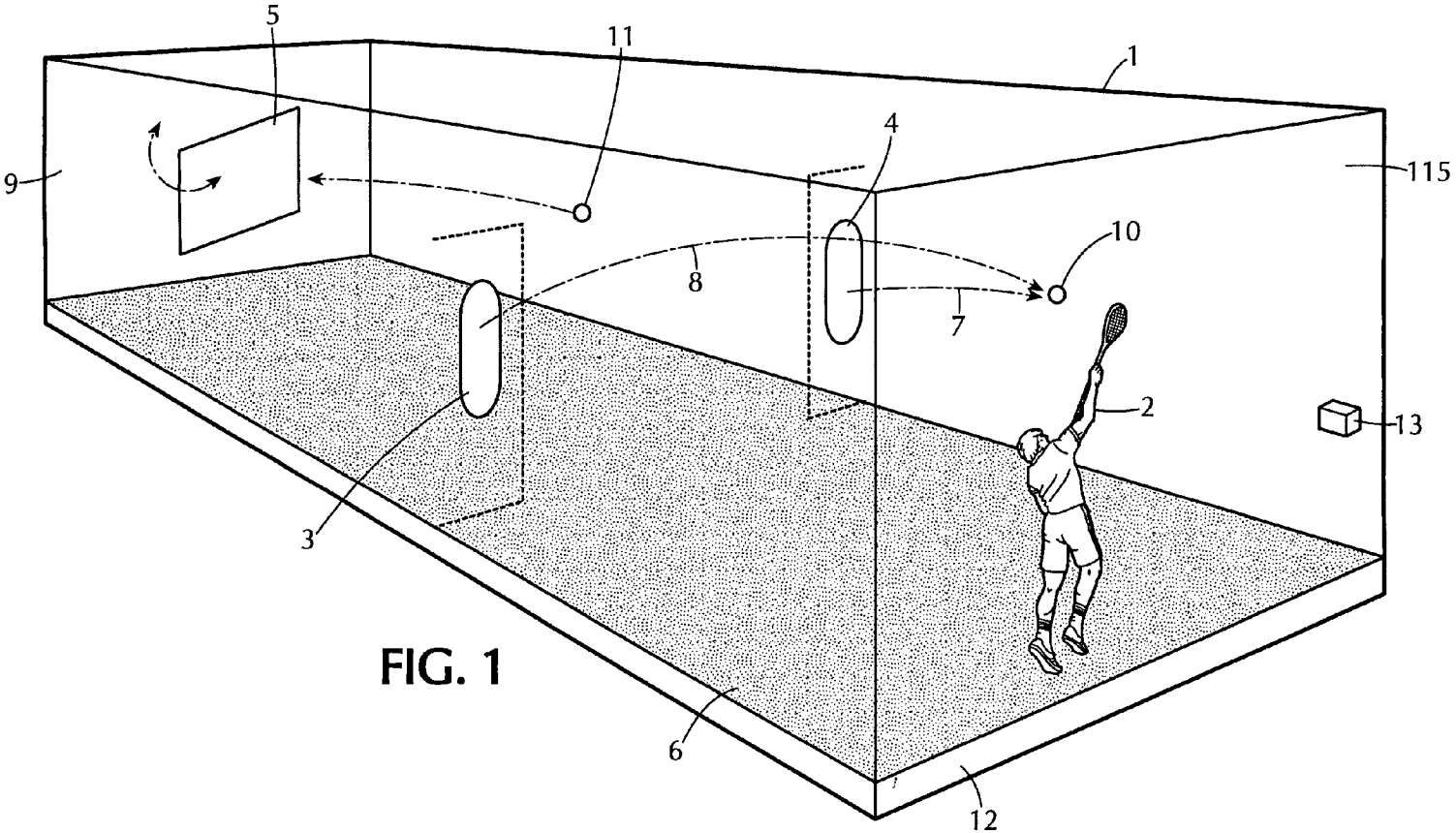
FIG. 1 is a perspective schematic representation of the lacrosse training and competitive game installation of this invention.

FIG. 1 shows a lacrosse training and competitive game installation 1 with player region 115, rotatable goal 5 at distal end 9, raised floor 12, player 2, and artificial grass surface 6. While one ball aperture may be used, preferably a pair of oval apertures 3 and 4 are located in side baffles extending forward of the area of goal 5. Oval apertures preferably each house a ball projector on each side and are used to project balls 10 to the player 2. While oval apertures are preferred, it is contemplated that other shaped apertures such as circular or other shaped apertures may be used. Ball 11 is being returned toward the goal 5 which can be rotated a predetermined angle, preferably 45 degrees, from forward in each direction in smaller angle increments, such as 15 degree increments, under computer motor control. Note that ball 10 could have been projected at high speed flat trajectory 7 from the right aperture 4 or as a parabolic high trajectory 8 at low speed from left aperture 3. Where player feedback is appropriate, a ruggedized sturdy card reader 3 in player region 115 is used by the player to identify him or herself to the control computer with vital statistics such as height; it can also have buttons and a small display to communicate session desires such as "I need overhand practice", etc. While oval apertures 3 and 4 for the ball projectors are shown approximately one half way down raised floor 12, it is contemplated that apertures 3 and 4 can be located anywhere from the goal area region to a predetermined area closer to the player.

Figure 2:
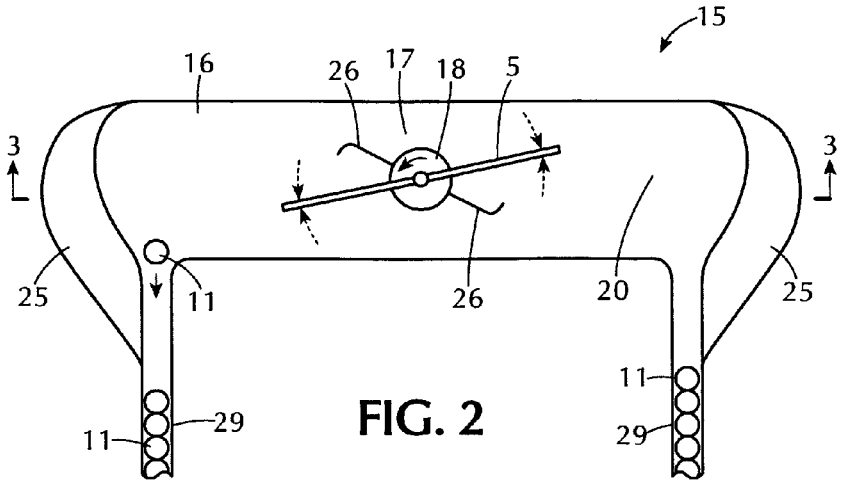
FIG. 2 is a top view of the ball return pit under the goal showing the gravity ball canals at each side sending balls forward to the ball projectors.
Figure 3:
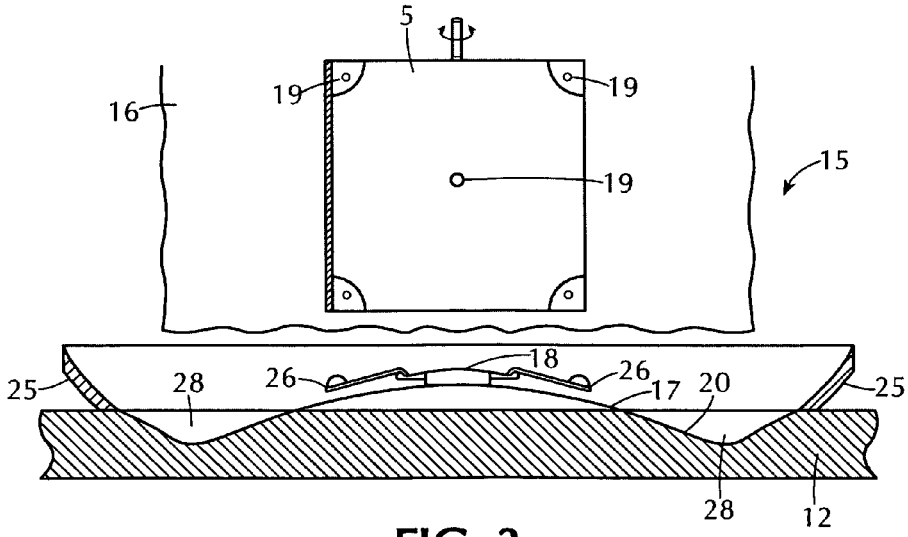
FIG. 3 is a side crossection of the ball return pit with equalizing motivator.

FIGS. 2 and 3 show the ball return subsystem 15 at the distal end in top and crossection views respectively. A ball return area, such as ball pit 20, receives returned balls 11 which drop in from the artificial grass 6 surface or fall from struck fabric goal 5 or fabric backdrop 16. The center region 17 is preferably raised and divides pit 20 into a right and left section each contoured with lowest regions 28 to guide balls 11 into right or left angled canals 29. A ball movement device keeps the flow of balls from backing up. For example, in one embodiment, preferably equalizing motivator rotates hinged arms 26 at a low speed via gearmotor 18 to insure that balls do not back up into either the right or left side. Elevated wings 25 insure that most badly returned balls 11 also end up in pit 20. Enhanced target markings are provided for the player. For example, note signal lights 19 embedded into goal 5. These can be used to guide player 2 to throw and shoot the ball at a certain region of goal 5. If feedback is preferred, embedded sensors, such as accelerometers, also embedded on the back side of the indicated regions of goal 5, sense a nearby throw and shoot and are used as feedback to the computer. Signal lights 19 are preferably ultra-bright AlInGa (aluminum indium gallium) surface mount light emitting diodes (LED's) in a variety of desirable colors such as yellow part number LTST-C170KYKT from Lite-On Corporation. For greater light output these LED's can be clustered in close proximity (as is typically done for flashlight use) for each of signal lights 19. Single axis analog or digital MEMS accelerometers such as Digi-Key part number 497-8961-1-ND produced by ST Corporation can be attached to or co-located with signal lights 19 on goal 5 surface to sense a hit by a returned ball in the vicinity of the lighted signal. As feedback to the control computer, peak acceleration (or better still, signal signature analysis) is used to score the sensed signal as a "hit" or "miss" or any other scaled score as directed by the software.

Figure 5:
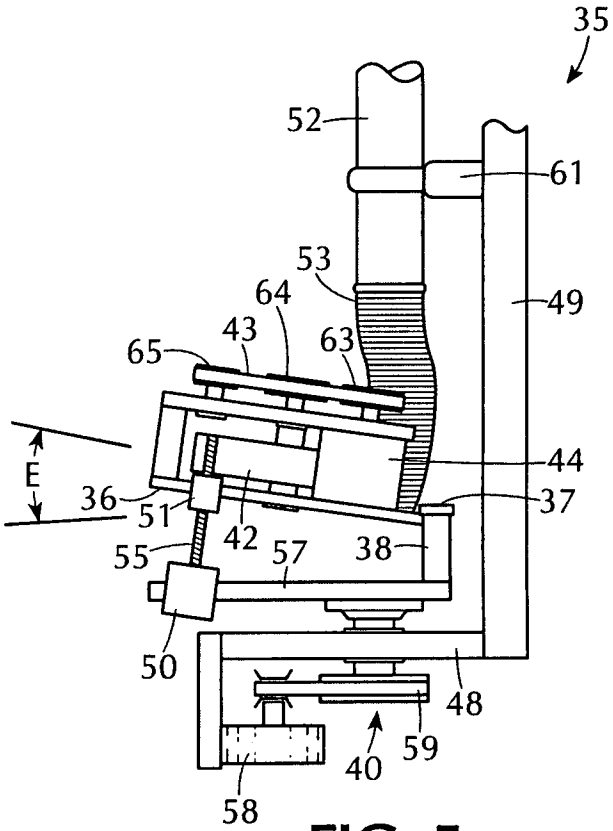
FIG. 5 is a side elevation of the ball projector of FIG. 4 showing the azimuth and elevation mechanisms.
Figure 4:
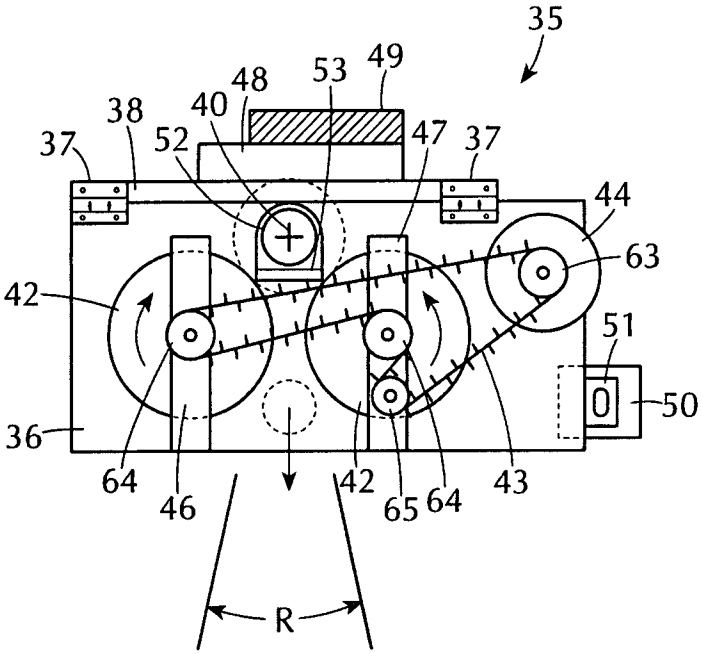
FIG. 4 is a top view of a ball projector sub-system showing the accelerator rollers driven by a variable speed motor via a serpentine double-sided timing belt.

FIGS. 4 and 5 show top and side views of ball projector subassembly 35. Top plate 36 has adjustable speed drive motor 44 and accelerator rollers 42 attached. Rollers 42 are preferably attached via brackets 46 and 47 and are driven by drivers, such as pulleys 64, in opposite directions via a movement regulator, such as, for example, serpentine double-sided timing belt 43 which couples to idler pulley 65 and motor pulley 63. Rollers 42 preferably have concave peripheral contours for better ball 11 grip. Plate 36 is preferably hinged at 37 to spacer block 38 attached to horizontal plate 57. Motor 50 adjusts the tilt. For example, motor 50, which is preferably attached to plate 57 on a swivel mount, adjusts tilt by, for example, turning lead screw 55 in either direction to adjust the tilt (elevation setting) of plate 36 via swivel mounted lead screw nut 51. While other motors can be used, motor 50 is preferably a stepper motor which would require no positional feedback to the control computer since its position would be always available as "home position" detected at system start-up, plus or minus all accumulated steps. This controls tilt as denoted over the range of "E" noted in FIG. 5. Horizontal plate 57 is rotated (azimuth control) over range "R" noted in FIG. 4, by motor 58 and timing belt drive 40 with timing belt 59 as shown in FIG. 5. Again motor 58 is preferably a stepper motor for similar reasons. Stationary plate 48 is attached to column bracket 49 which supports the ball elevator. Tube 52 rigidly attached to column 49 via bracket 61 conveys balls 11 one at a time from the ball elevator upon command. Lacrosse balls are moved forward in a forward space, such as, for example, via a conduit. For example, in one embodiment, flexible corrugated tube 53 is rigidly attached to plate 36 at its distal end so as to direct balls 11 directly between accelerator rollers 42. The upper end of tube 53 is a loose fit onto tube 52 so as to permit rotating movement around tube 52. Note that the center of rotation of plate 57 is preferably directly below the center of tube 52.

Figure 7:
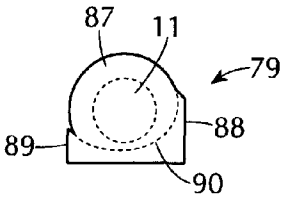
FIG. 7 is a side detail of a ball scoop.
Figure 8:
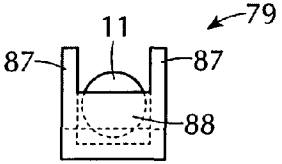
FIG. 8 is a front view of a ball scoop.
Figure 6:
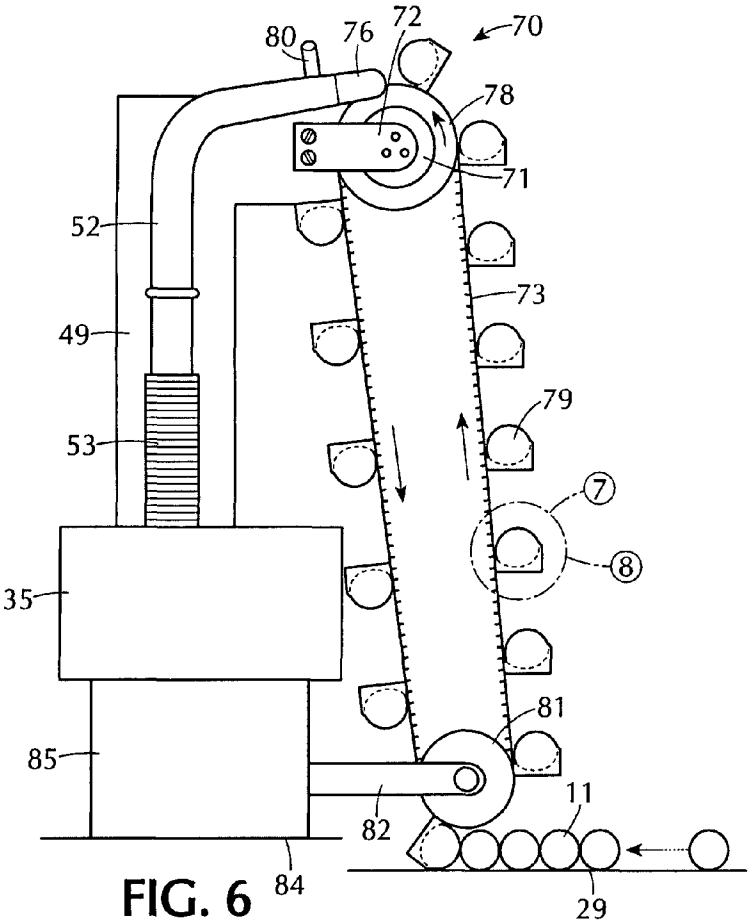
FIG. 6 is a side elevation of the integration of the ball lift elevator with the ball projector sub-assembly (depicted schematically as a block) for a stage one embodiment.

FIG. 6 shows the configuration of a preferable optional ball elevator 70 in relation to ball projector 35 subassembly (here shown only as a rectangle) for a stage one embodiment. Note that subassembly 35 is preferably rigidly mounted to stationary base 85 on floor 84. Ball elevator 70 uses ball capturing devices, such as, spaced-apart scoops 79 (see side and front details of FIGS. 7 and 8) attached to a connector, such as a long timing belt 73 driven by stepper motor 71 via pulley 78. Scoops 79 preferably have high front lip 88, low back attachment lip 89, sides 87 and a concave inside contour 90. In operation, elevator 70 is attached to column bracket 49 via motor bracket 72 at the top and rigidly attached to base 85 via bracket 82 at the bottom poised above ball canals 29. Scoops 79 pick up a ball from canal 29 with the same intermittent movement that dumps a ball into tube 52 at the top where baffles 76 guide the ball from scoop 79 into tube 52. A sensor, such as, for example a photoelectric detector 80, detects the movement of a ball 11 and immediately signals the computer to stop motor 71 as ball 11 is being accelerated from the ball projector below.

Figure 9:
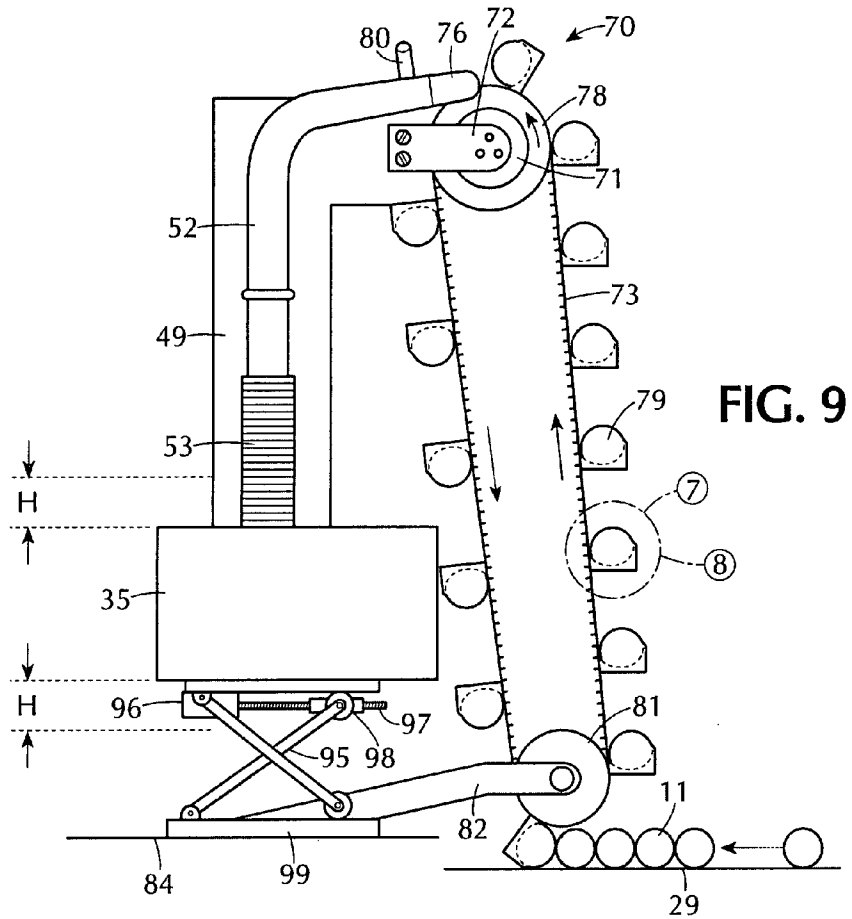
FIG. 9 is a side elevation showing the addition of a stationary lift table under the ball projector to convert to a stage two embodiment with height control.

FIG. 9 shows the further optional substitution of motor operated lift table 95 as a substitute for base 85 in FIG. 6. This optional embodiment converts the installation into an alternate embodiment for a stage two embodiment with height control. Motor 96 uses a lift mechanism, such as, for example, by driving lead screw 97 in either direction to raise or lower table 95 via lead screw nut 98. Note that corrugated tube 53 can also slide loosely up and down tube 52 from ball elevator 70. Height variation "H" can be achieved up or down from a central position. Note that lower bracket 82 is now attached to fixed table bottom plate 99.

Figure 10:
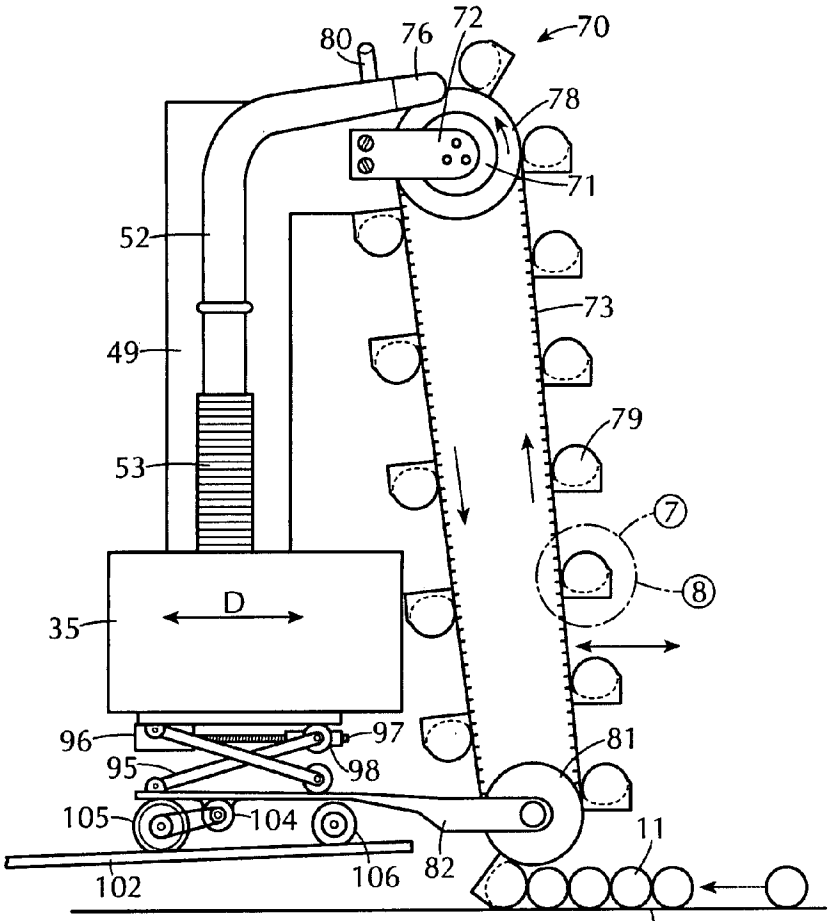
FIG. 10 is a side elevation showing the addition of a motion motor and rail guided wheels to the bottom of the lift table converting to a stage three embodiment with distance control from the ball projector to the player.

FIG. 10 shows a further alternate embodiment with the preferable addition of driven wheel 105, smaller non-driven wheel 106 under lift table 95, with drive motor 104, to achieve back and forth motion, to vary distance "D" from or to player region 115 as guided by rails 102. This permits better control of trajectory since now balls can come toward the player from deeper down range as well as closer to the player and more transverse. Note that these additional components convert an optional stage two embodiment into an optional stage three embodiment with elevation, azimuth, height and distance adjustments. Also note that in this embodiment, ball elevator 70 moves longitudinally with ball projector subsystem 35 along an angled guide rail 102 parallel to ball canal 29 by virtue of an attachment, such as, for example, bracket 82, being attached to table 95's bottom platform.

Figure 11:
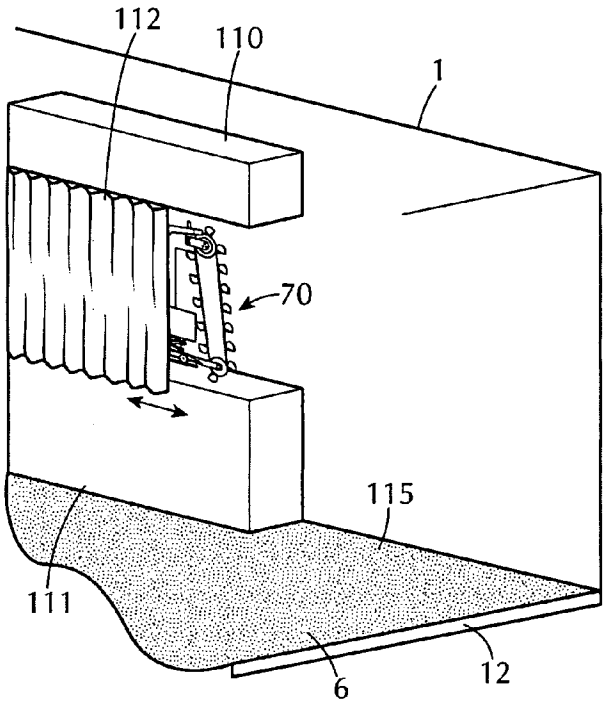
FIG. 11 is a perspective detail of the side enclosure for a ball projector needed for a stage three embodiment.

As shown in FIG. 11, for optional stage three embodiment, the oval ejector contours of FIGS. 1 (3 and 4) are no longer adequate for viewing obstacles, such as, for example, upper and lower baffles 110 and 111 are used to separate ball projector subsystems from prominent player view, while also affording the trajectory freedom required consistent with the variable distance from the player region. In a further effort to keep distracting mechanisms from view, another viewing obstacle, such as a dark curtain 112, can have its leading edge attached to the ball projector and elevator subsystem so that it would open and close in synchronism with distance adjustment.

Figure 12:
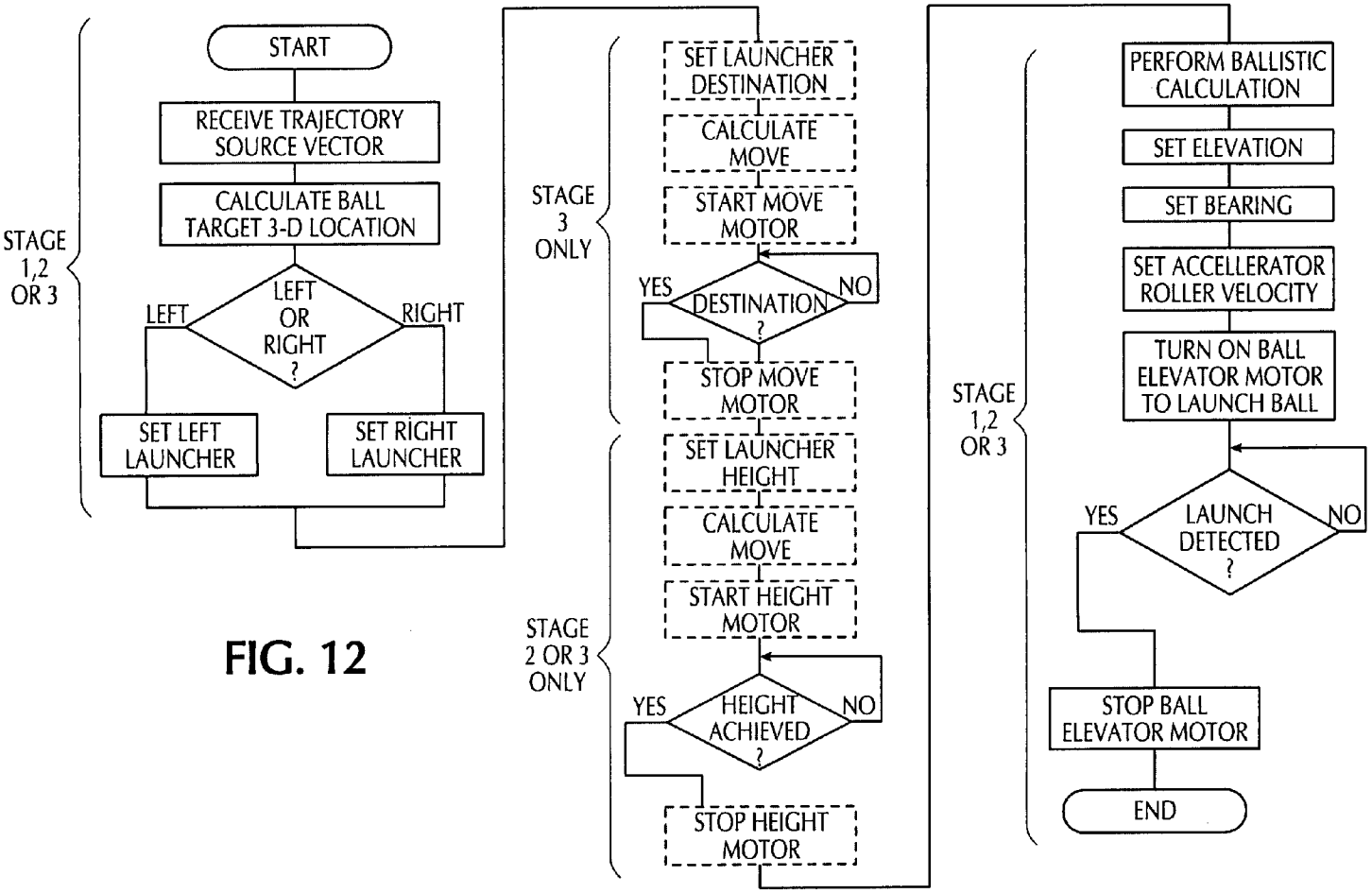
FIG. 12 is a high level flow chart of the control computer logic steps in launching a ball to a player.

FIG. 12 is a high level flowchart of the optional software control logic for launching or projecting a ball to a player. Dashed lines are used around the blocks of the more complex embodiments. These optional blocks can be skipped if the embodiment features are not implemented. Also note that ball projectors are called "launchers" in this flow chart. The first few blocks are set-up. A trajectory source vector is a set of parameters required before starting the launch operation. Some of these may be player input such as training type desired, general ball speed, left/right/up/down, while others may be computer generated such as random combinations. In any case, the target location of the ball in 3-D space must be calculated from some of the vector information. Left or right must be decided by player or computer. Then the stage two or three variations should be set as they are key inputs to the ballistic calculation which must "know" the exact location of the ball projector or launcher to calculate distance to the ball target location. After the ballistic calculation, the elevation and bearing or azimuth are set and then the ball elevator motor is turned on to drop one ball into the launcher. The height and location (fore and aft) can be set simultaneously since they are independent. Similarly, the elevation, bearing and roller velocity can also be set simultaneously. In this flow chart of FIG. 12, they are shown as serial operations.

Therefore, in general, the lacrosse training and competitive game installation preferably includes an elongated enclosed space having a pair of side walls and containing a goal area 5 adjacent one end of the space and a player area 115 at an opposite end thereof. While the geometry of the enclosed space can vary, the goal area preferably has a rear wall and one or more respective baffle regions projecting forward from the rear wall of the goal area. Each projecting baffle region each has one or more throwing apertures 3, 4, through which lacrosse balls 10 are hurled into the enclosed space in sequences. At least one movably pivotable ball projector assembly is mounted behind the one or more baffle regions adjacent to the throwing apertures, for hurling the lacrosse balls 10, 11 at multiple selected trajectory angles and/or arcs into the enclosed space, simulating passed lacrosse balls 10, 11 thrown or bounced between players. A simulated goal simulates actual player throwing and shooting of balls toward the simulated goal. A collection system collects balls from the goal area and delivers the balls to each ball projector assembly.

Each ball projector assembly includes a ball projector 35 having an ejection port aligned with a throwing aperture, a base supporting the ball projector, a preferably flexible and corrugated vertical tube for dropping incoming balls into the ball projector 35, and a ball elevator 70 for picking up lacrosse balls from a canal containing returned balls, and carrying returned balls up to baffles above the ball projector 35, whereby baffles direct the returned balls into the respective vertical tube 52.

Optionally, the ball elevator 70 includes a timing belt riding on pulleys, and scoops mounted on the timing belt to scoop up a ball 10, 11 from each canal.

Each ball projector 35 preferably includes a plate 36 having mounted thereon an adjustable speed drive motor 44 and accelerator rollers 42 for engaging and hurling the lacrosse balls 10, 11. The plate 36 has preferably one edge 37 hinged and attached to a spacer block 38 mounted on a horizontal plate 57, and a motor 50 driven lead screw for adjusting tilt of the top plate 36 about the hinged edge thereof, for changing the vertical angle of movement of balls 10, 11 through each hurling aperture 3 or 4. The horizontal plate is mounted for rotation in a horizontal plane, wherein an azimuth motor 58 is preferably supported on a stationary plate 48 to rotate the horizontal plate 57 to change azimuth direction of the lacrosse balls 10, 11 being hurled through the hurling aperture 3 or 4. Preferably, the stationary plate 48 rotates about a shaft which is aligned with a fixed and stationary portion of the aforementioned vertical tube 52.

Preferably, the system for collecting balls 10, 11 from the goal area and delivering the balls to each ball projector assembly 35 includes a ball pit 20 extending across a width of the enclosed space, between the side walls of the space, having a raised center region dividing the pit into right and left sections to direct balls 10, 11 into the respective canals on each side of the enclosure, with an equalizing motivator, such as having hinged arms 26 rotating at a low speed via gearmotor 18 located on top of the raised center region, being rotationally mounted, to insure that balls 10, 11 do not back up into either of the left or right sections.

The lacrosse training and competitive game installation includes a base which preferably is a platform assembly which is vertically adjustable, to adjust the height at which the lacrosse balls 10, 11 are being hurled, wherein the throwing apertures are sized and shaped to accommodate adjustments of the respective projectors.

The platform assembly also preferably has upper and lower platform plates with height adjustable means 96 for raising or lowering the upper platform plate with respect to the lower platform plate.

Preferably, the lower platform plate is supported on wheels 105, riding on rails 102, whereby the ball projector assembly is movable toward and away from the player area 115.

Preferably, the bracket is attached to, and extends from, the lower platform plate, wherein a distal end of the bracket is attached to and supports the bottom pulley of the elevator, whereby the bottom pulley is adjustable along a length of the ball return canal, so that scoops on the timing belt are always appropriately spaced from the lower platform plate.

To make the simulated lacrosse practice more intriguing, the lacrosse training and competitive game installation hides some structural details of the lacrosse training and competitive game installation from the player's view by a curtain 112 or other view obstruction member.

In a preferred embodiment, each ball projector 35 is vertically movable, and a ball projector sub-assembly is placed on a motorized lift mechanism to control actual height of the one ball projector 35. This motorized lift mechanism preferably includes a motor, such as for example a motor 50 driving a lead screw in either direction, to raise or lower a table via a lifter, such as a lead screw nut, wherein variation can be achieved up or down from a central position.

The ball projector 35 can also be horizontally movable, or both horizontally and vertically movable. Movement can be achieved when the ball projector assembly is placed on rails 102 and is provided with motorized wheels to move the ball projector physically closer or farther away from the player to control the trajectory of the ball in the lateral or forward directions. Optionally, these motorized wheels include a driven wheel 105, one or more non-driven wheels 106 under a lift table 95, a drive motor 104 importing back and forth motion of the lift table on the wheels, to vary predetermined distance from or to a player region 115 as guided by the rails 102, to permit control of parabolic trajectory of the balls 10, 11 toward the player area 115 from deeper down range to as close to the player area 115 with more transverse ball trajectories, as is possible, wherein the ball trajectories vary in elevation, azimuth, height and distance adjustments.

The motorized lift mechanism also moves longitudinally with the ball projector assembly, moving along an angled guide rail parallel to the ball return canal. The horizontally movable ball projector 35 assembly preferably moves horizontally along the rails between further baffles extending along each side wall of the elongated enclosed space. Each baffle region is preferably a pair of respective left and right forward projecting side baffle regions projecting forward from the rear wall of the goal area; wherein each of the projecting side baffle regions has a respective throwing aperture, through which lacrosse balls are hurled into said enclosed space in sequence.

The ball projector assembly can be a plurality of ball projector assemblies 35, with each ball projector assembly 35 mounted behind a respective side baffle 110, 111 with optional curtain 112, adjacent each of the throwing apertures for hurling the lacrosse balls 10, 11 into the enclosed space, simulating passed balls between players. The simulated goal is mounted for rotation around a vertical axis in the goal area for simulating throwing and shooting of balls at various angles to a goal. Balls 10, 11 are collected from the goal area and delivered to each ball projector assembly 35.

To stimulate accurate throwing of the lacrosse balls 10, 11, the simulated goal may include one or more signal lights 19 embedded with marked target areas of the goal, wherein the respective signal lights guide the player to throw and shoot the ball at a certain region of the simulated goal. One or more ball sensors are embedded on one or more specified regions on a back side of the simulated goal sensing device, to a nearby throw and shoot of each ball, to transmit feedback to an optional computer, wherein the one or more sensors are preferably accelerometers. The signal lights 19 may be ultra-bright AlInGa (aluminum indium gallium) surface mount light emitting diodes (LED's) or other suitable lights. The accelerometers are preferably single axis analog or digital MEMS accelerometers, located with the signal lights 19 on the simulated goal surface, to sense a hit by a returned ball 10, 11 in the vicinity of the lighted signals on the simulated goal. The accelerometer sends feedback to the computer of peak acceleration, and/or signal signature analysis, to score the sensed signal as a "hit" or "miss", or any other scaled score as directed by the software of the computer.

In use, a method for training and providing a competitive lacrosse game installation for lacrosse players includes the steps of:

a) providing an elongated enclosed space having a pair of side walls and containing a goal area adjacent one end of said space and a player area at an opposite end thereof, where the goal area has a rear wall and respective left and right forward projecting side baffle regions projecting forward from said rear wall of said goal area;

b) each of said side baffle regions having a throwing aperture through which lacrosse balls are hurled into said enclosed space in sequence;

c) mounting a ball projector assembly behind said side baffle adjacent each of said throwing apertures for hurling said lacrosse balls into said enclosed space;

d) mounting a simulated goal for rotation around a vertical axis in said goal area for simulating throwing and shooting of balls at various angles and trajectories to a goal;

e) installing a system for collecting balls from said goal area and delivering said balls to each said ball projector assembly; and f) directing said ball projector assemblies to hurl balls sequentially and alternately from opposite throwing apertures into said player space, changing direction and height of said balls, and simultaneously rotating said simulated goal to train each player to receive passes from other players and throw each ball received at said simulated target at any angle.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A lacrosse training and competitive game installation comprising:

an elongated enclosed space having a pair of side walls and containing a goal area adjacent one end of said space and a player area at an opposite end thereof;

said goal area having a rear wall and at least one respective baffle region projecting forward from said rear wall of said goal area;

said at least one projecting baffle region having at least one throwing aperture through which lacrosse balls are hurled into said enclosed space in sequence;

at least one movably pivotable ball projector assembly mounted behind said at least one baffle region adjacent said at least one throwing apertures for hurling said lacrosse balls at multiple selected trajectory angles and arcs into said enclosed space simulating passed balls between players;

a simulated goal for simulating throwing and shooting of balls toward said simulated goal;

a system for collecting balls from said goal area and delivering said balls to said at least one ball projector assembly;

said system for delivering said balls incorporating a ball elevator associated and adjacent to said at least one ball projector assembly, which said ball elevator lifts said lacrosse balls from a return canal below, to baffles above said at least one ball projector; and, said at least one ball projector assembly further hurling said lacrosse balls sequentially and alternately from opposite throwing apertures into said player area, changing direction and height of said lacrosse balls, and simultaneously rotating said simulated goal to train players to receive passes from other players and throw each lacrosse ball received at said simulated target at a variety of angles.

2. The lacrosse training and competitive game installation of claim 1 in which at least one ball projector assembly comprises a ball projector having an ejection port aligned with a throwing aperture, a base supporting said ball projector, a vertical tube for dropping incoming balls into said at least one ball projector, and wherein said at least one baffle directing said returned balls into said vertical tube.

3. The lacrosse training and competitive game installation of claim 2 in which said ball elevator comprises a timing belt riding on pulleys, and scoops mounted on said timing belt to scoop up a ball each from said canal.

4. A method of training and using a competitive game installation for lacrosse players comprising the steps of:

selecting said competitive game installation, said competitive game installation including an elongated enclosed space having a pair of side walls and containing a simulated goal area adjacent one end of said space and a player area at an opposite end thereof, said goal area having a rear wall and respective left and right forward projecting side baffle regions projecting forward from said rear wall of said goal area;

each of said side baffle regions having a throwing aperture through which lacrosse balls are hurled into said enclosed space in sequence;

mounting a ball projector assembly behind said left and right side baffle adjacent each of said throwing apertures for hurling said lacrosse bails into said enclosed space;

mounting a simulated goal for rotation around a vertical axis in said goal area for simulating throwing and shooting of balls at various angles to a goal;

installing a system for collecting balls from said goal area and delivering said balls to each said ball projector assembly;

said system for delivering said balls incorporating a ball elevator associated and adjacent to each said ball projector assembly, which said ball elevator lifts said balls from a return canal below to the input atop of said associated ball projector; and, directing said ball projector assemblies to hurl balls sequentially and alternately from opposite throwing apertures into said player area, changing direction and height of said balls, and simultaneously rotating said simulated goal to train each player to receive passes from other players and throw each ball received at said simulated target at a variety of angles.

5. The method of training and using a competitive game installation for lacrosse players of claim 4 further comprising the step of providing each ball projector with a top plate having mounted thereon accelerator rollers for engaging mad hurling said balls, said plate having one edge hinged and attached to a spacer block mounted on a horizontal plate, and a motor driven lead screw for adjusting tilt of said top plate about said hinged edge thereof for changing the vertical angle of movement of balls through each said hurling aperture.

6. The method of training and using a competitive game installation for lacrosse players of claim 5 in which said horizontal plate is mounted for rotation in a horizontal plane, an azimuth motor being supported on a stationary plate for rotating said horizontal plate for changing azimuth direction of said balls being hurled through said at least one hurling aperture.

7. The method of training and using a competitive game installation for lacrosse players of claim 6 in which at least a portion of said vertical tube is flexible and corrugated to allow for movement of said top plate.

8. The method of training and using a competitive game installation for lacrosse players of claim 7 further comprising the step of rotating said stationary plate about a shaft which is aligned with a fixed and stationary portion of said vertical tube.

9. The method of training and using a competitive game installation for lacrosse players of claim 8 in which said system for collecting balls from said goal area and delivering said balls to each said ball projector assembly further comprising the step of extending a ball pit across a width of said enclosed space between said side walls having a raised center region and dividing said pit into right mad left sections to direct balls into said canal on each side of said enclosure, and providing an equalizing motivator on top of said raised center region rotationally mounted to insure that balls do not back up into either of said left or right sections.

10. The method of training and using a competitive game installation for lacrosse players of claim 9 in which said ball projector assembly is vertically adjustable to adjust the height at which said balls are being hurled, said throwing apertures being sized and shaped to accommodate adjustments of said at least one ball projector.

11. The method of training and using a competitive game installation for lacrosse players of claim 10 in which said platform assembly comprises upper and lower platform plates with means for raising or lowering said upper platform plate with respect to said lower platform plate.

12. The method of training and using a competitive game installation for lacrosse players of claim 11 further comprising the step of supporting said lower platform plate on wheels riding on rails whereby and moving said at least one ball projector assembly is movable toward and away from said player area.

13. The method of training and using a competitive game installation for lacrosse players of claim 12 further comprising the step of attaching and extending a bracket from said lower platform plate, a distal end of said bracket being attached to and supporting the bottom pulley of said elevator and adjusting said bottom pulley along a length of said canal so that scoops on said timing belt are always appropriately spaced from said lower platform plate.

14. The method of training and using a competitive game installation for lacrosse players of claim 13 having means to hide further comprising the step of hiding some structural details of said and competitive game installation from a player's view.

15. The method of training and using a competitive game installation for lacrosse players of 4, further comprising the step of moving said at least one ball projector vertically.

16. The method of training and using a competitive game installation for lacrosse players of claim 15, further comprising the step of placing said at least one ball projector subassembly on a motorized lift mechanism to control actual height of said at least one ball projector.

17. The method of training and using a competitive game installation for lacrosse players of claim 16 further comprising the step of providing said motorized lift mechanism with a motor driving a lead screw in either direction to raise or lower a table via a lead screw nut, wherein variation can be achieved up or down from a central position.

18. The method of training and using a competitive game installation for lacrosse players of claim 4, further comprising the step of moving said at least one ball projector horizontally movable.

19. The method of training and using a competitive game installation for lacrosse players of claim 4, further comprising the step of moving said at least one ball projector horizontally and vertically movable.

20. The method of training and using a competitive game installation for lacrosse players of claim 18, further comprising the step of placing said ball projector assembly on rails and providing said ball projector assembly with motorized wheels to move said ball projector physically closer or farther away from the player, thereby controlling the trajectory of the ball in the lateral or forward directions.

21. The method of training and using a competitive game installation for lacrosse players as in claim 19, wherein said motorized wheels comprise a driven wheel, one or more non-driven wheels under a lift table, a drive motor importing back and forth motion of said lift table on said wheels, to vary predetermined distance from or to a player region as guided by said rails, thereby permitting control of trajectory of said balls toward said player area from deeper down range to as close to the player area with more transverse ball trajectories, and varying said ball trajectories in elevation, azimuth, height and distance adjustments.

22. The method of training and using a competitive game installation for lacrosse players as in claim 20, further comprising the step of moving said motorized lift mechanism longitudinally with said at least one ball projector assembly, moving along an angled guide rail parallel to said ball canal.

23. The method of training and using a competitive game installation for lacrosse players as in claim 21, further comprising the step of moving said horizontally movable ball projector assembly horizontally along said rails between further baffles extending along said at least one side wail of said elongated enclosed space.

24. The method of training and using a competitive game installation for lacrosse players of claim 4 wherein said at least one baffle region is a pair of respective left and right forward projecting side baffle regions projecting forward from said rear wall of said goal area; each of said projecting side baffle regions having a respective throwing aperture through which lacrosse balls are hurled into said enclosed space in sequence;

said at least one ball projector assembly being a plurality of ball projector assemblies, each said ball projector assembly mounted behind a respective side baffle adjacent each of said throwing apertures for hurling said lacrosse balls into said enclosed space simulating passed balls between players;

mounting and rotating said simulated goal around a vertical axis in said goal area and simulating throwing and shooting of balls at various angles to a goal; and collecting balls from said goal area and delivering said balls to each said ball projector assembly.

25. The method of training and using a competitive game installation for lacrosse players of claim 24, further comprising the step of embedding one or more signal lights embedded with marked target areas of said simulated goal, and using said one or more signal lights to guide the player to throw and shoot the ball at a certain region of said simulated goal.

26. The method of training and using a competitive game installation for lacrosse players as in claim 25, further comprising the step of embedding one or more ball sensors embeg4e4 on a one or more specified regions on a back side of said simulated goal for sensing a nearby throw and shoot of said ball and transmitting feedback to a computer.

27. The method of training and using a competitive game installation for lacrosse players as in claim 26, wherein said one or more sensors are accelerometers.

28. The method of training and using a competitive game installation for lacrosse players as in claim 25, wherein said one or more signal lights are ultra-bright AllnGa (aluminum indium gallium) surface mount light emitting diodes (LED's).

29. The method of training and using a competitive game installation for lacrosse players as in claim 27, wherein said at least one accelerometers are single axis analog or digital MEMS accelerometers located with said one or more signal lights on said simulated goal surface to sense a hit by a returned ball in the vicinity of said lighted signals on said simulated goal, said at least one accelerometer sending feedback to said computer of peak acceleration, and/or signal signature analysis to score said sensed signal as a "hit" or "miss" or any other scaled score as directed by the software of said computer.

* * * * *